US011703231B2

(12) United States Patent
Haley et al.

(10) Patent No.: US 11,703,231 B2
(45) Date of Patent: Jul. 18, 2023

(54) HEMMED SHELF FOR APPLIANCE-MODULE ASSEMBLY

(71) Applicant: Electrolux Home Products, Inc., Charlotte, NC (US)

(72) Inventors: Henry Haley, Auburn, KY (US); Michael Anthony Howard, Gallatin, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 345 days.

(21) Appl. No.: 16/847,950

(22) Filed: Apr. 14, 2020

(65) Prior Publication Data

US 2021/0317993 A1 Oct. 14, 2021

(51) Int. Cl.

| | |
|---|---|
| ***F24C 15/02*** | (2006.01) |
| ***F24C 15/30*** | (2006.01) |
| ***F24C 15/16*** | (2006.01) |
| ***F24C 15/10*** | (2006.01) |

(52) U.S. Cl.

CPC ..... *F24C 15/028* (2013.01); *F24C 15/10* (2013.01); *F24C 15/16* (2013.01); *F24C 15/30* (2013.01)

(58) Field of Classification Search

CPC ..... F24C 15/16; F24C 15/30; F24C 15/08; F24C 15/028; H05B 6/64; A47B 77/00

See application file for complete search history.

(56) References Cited

U.S. PATENT DOCUMENTS

| | | | | |
|---|---|---|---|---|
| 1,776,929 | A * | 9/1930 | Reedy | F24C 15/14 126/339 |
| 2,335,279 | A | 11/1943 | Hobson | |
| 2,507,661 | A | 5/1950 | Cook et al. | |
| 3,373,754 | A * | 3/1968 | Squire | A47L 15/0097 134/115 R |
| 3,550,978 | A * | 12/1970 | Magee | A47B 88/43 312/108 |
| 3,765,549 | A * | 10/1973 | Jones | G21C 19/32 414/290 |
| 5,549,374 | A * | 8/1996 | Krivec | A47B 88/417 384/42 |
| 6,185,899 | B1 * | 2/2001 | De Niet | A47F 5/0846 211/187 |
| 6,191,391 | B1 * | 2/2001 | Deo | F24C 15/18 126/273 R |
| 7,921,617 | B2 * | 4/2011 | Stevens | E04C 2/384 52/356 |
| 9,395,088 | B2 * | 7/2016 | Wiggins | F24C 15/008 |

(Continued)

FOREIGN PATENT DOCUMENTS

| | | |
|---|---|---|
| DE | 10228297 | 1/2004 |
| KR | 101692624 | 12/2016 |
| WO | 2010034833 | 4/2010 |

*Primary Examiner* — David J Laux

(74) *Attorney, Agent, or Firm* — Pearne & Gordon LLP

(57) ABSTRACT

An appliance including a cooking cavity wrapper and a first side wall disposed laterally adjacent a first side of the cooking cavity wrapper. The first side wall includes a first hemmed shelf formed as a U-shaped bend therein. The U-shaped bend defines an inward-extending flange comprising a top leg and a bottom leg disposed in face-to-face adjacency with one another. The first hemmed shelf is adapted to support a module of the appliance above the cooking cavity wrapper.

15 Claims, 6 Drawing Sheets

(56) References Cited

U.S. PATENT DOCUMENTS

| | | | | |
|---|---|---|---|---|
| 2007/0158280 | A1* | 7/2007 | Cox | H05K 7/1488 211/26 |
| 2008/0190300 | A1* | 8/2008 | Adamski | F24C 15/008 99/341 |
| 2014/0239793 | A1* | 8/2014 | Armstrong | F24C 15/16 312/334.7 |
| 2016/0296012 | A1* | 10/2016 | Ciccacci | A47B 77/08 |
| 2019/0101293 | A1 | 4/2019 | Kim et al. | |
| 2020/0217512 | A1* | 7/2020 | Clayton | F24C 7/046 |

* cited by examiner

HEMMED SHELF FOR APPLIANCE-MODULE ASSEMBLY

FIELD OF THE INVENTION

The following description relates generally to a hemmed shelf integrated into a sheet metal part of an appliance to facilitate modular appliance assembly.

BACKGROUND OF THE INVENTION

Appliances conventionally include modular systems, e.g. a cooling module, a microwave oven or an upper oven of a double wall oven, that are secured to a housing of the appliance using a variety of conventional brackets and/or fasteners. For example, cooking ranges may include a pair of structural side walls at opposing lateral sides, which provides support to the appliance. Brackets and/or fasteners may be used to secure separately manufactured and supplied modules to the side walls of the cooking range, in order to attach that those module(s) to the range. If a cooling system is supplied as a separate module, that cooling system can be mounted above the cavity wrapper of a subjacent oven module, which also can be fastened to the appliance side walls via separate brackets. Or in the case of a double wall-oven, a second (upper) oven module including its respective cavity wrapper and associated hardware can be affixed to the side walls via separate brackets above the first (lower) oven module.

As will be appreciated, each separate component or subassembly (i.e. 'module') that must be secured to the structural side walls of the appliance introduces numerous additional and separate components (brackets and fasteners), which complicate manufacturing and assembly.

The present application discloses hemmed sidewalls for securing such separately supplied modules to the sidewalls to yield an integrated appliance comprising all of the combined modules.

SUMMARY OF THE INVENTION

The following presents a simplified summary in order to provide a basic understanding of the embodiments described herein. This summary is not an extensive overview nor is it intended to identify key or critical elements. Its sole purpose is to present some concepts in a simplified form as a prelude to the more detailed description that is presented later.

There is provided an appliance including a cooking cavity wrapper and a first side wall disposed laterally adjacent a first side of the cooking cavity wrapper. The first side wall includes a first hemmed shelf formed as a U-shaped bend therein. The U-shaped bend defines an inward-extending flange comprising a top leg and a bottom leg disposed in face-to-face adjacency with one another. The first hemmed shelf is adapted to support a module of the appliance above the cooking cavity wrapper.

There is also provided an appliance that includes a cooking cavity wrapper. A first side wall is disposed laterally adjacent a first side of the cooking cavity wrapper and includes a first hemmed shelf extending inward therefrom. The first hemmed shelf is formed as a U-shaped bend in the first side wall. The U-shaped bend defines an inward-extending first flange comprising a top leg and a bottom leg disposed in face-to-face adjacency with one another. A second side wall is disposed laterally adjacent a second side of the cooking cavity wrapper and includes a second hemmed shelf extending inward therefrom. The second hemmed shelf is formed as a U-shaped bend in the second side wall. The U-shaped bend defines an inward-extending second flange comprising a top leg and a bottom leg disposed in face-to-face adjacency with one another. The second hemmed shelf opposes the first hemmed shelf. A module is disposed above the cooking cavity wrapper and rests on the first hemmed shelf and the second hemmed shelf without additional brackets to provide structural support to the module resting on the first and second hemmed shelves.

Other features and aspects will be apparent from the following detailed description, the drawings, and the claims.

BRIEF DESCRIPTION OF THE DRAWINGS

Throughout the drawings and the detailed description, unless otherwise described, the same drawing reference numerals can be understood to refer to the same elements, features, and structures. The relative size and depiction of these elements may be exaggerated for clarity, illustration, and convenience.

DETAILED DESCRIPTION OF PREFERRED EMBODIMENTS

Example embodiments are described and illustrated herein. These illustrated examples are not intended to be a limitation on the invention. For example, one or more aspects can be utilized in other embodiments and other types of appliances.

Figure 1:
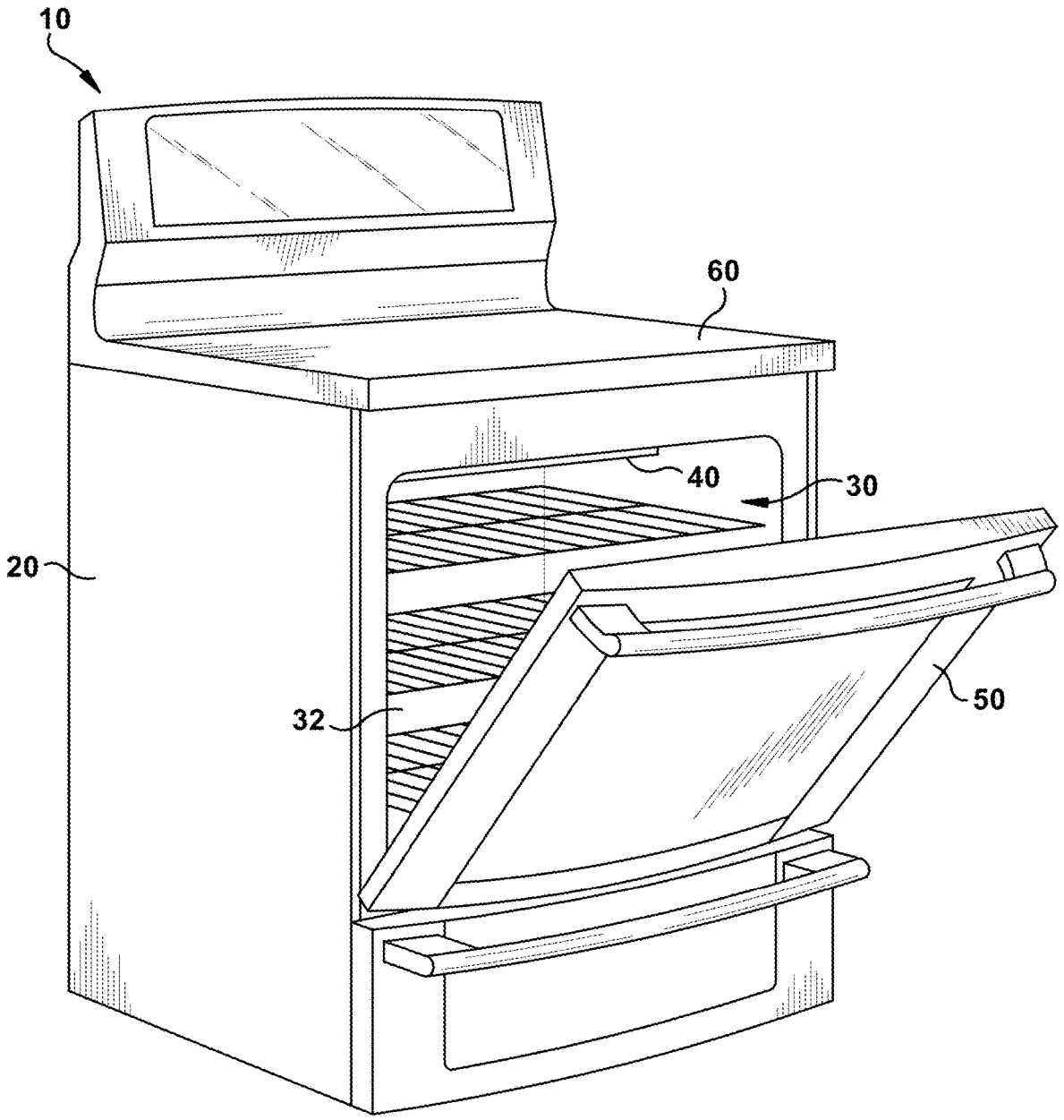
FIG. 1 is a front perspective view of an oven having an oven cavity, with a door of the oven cavity in an open position.
Figure 2:
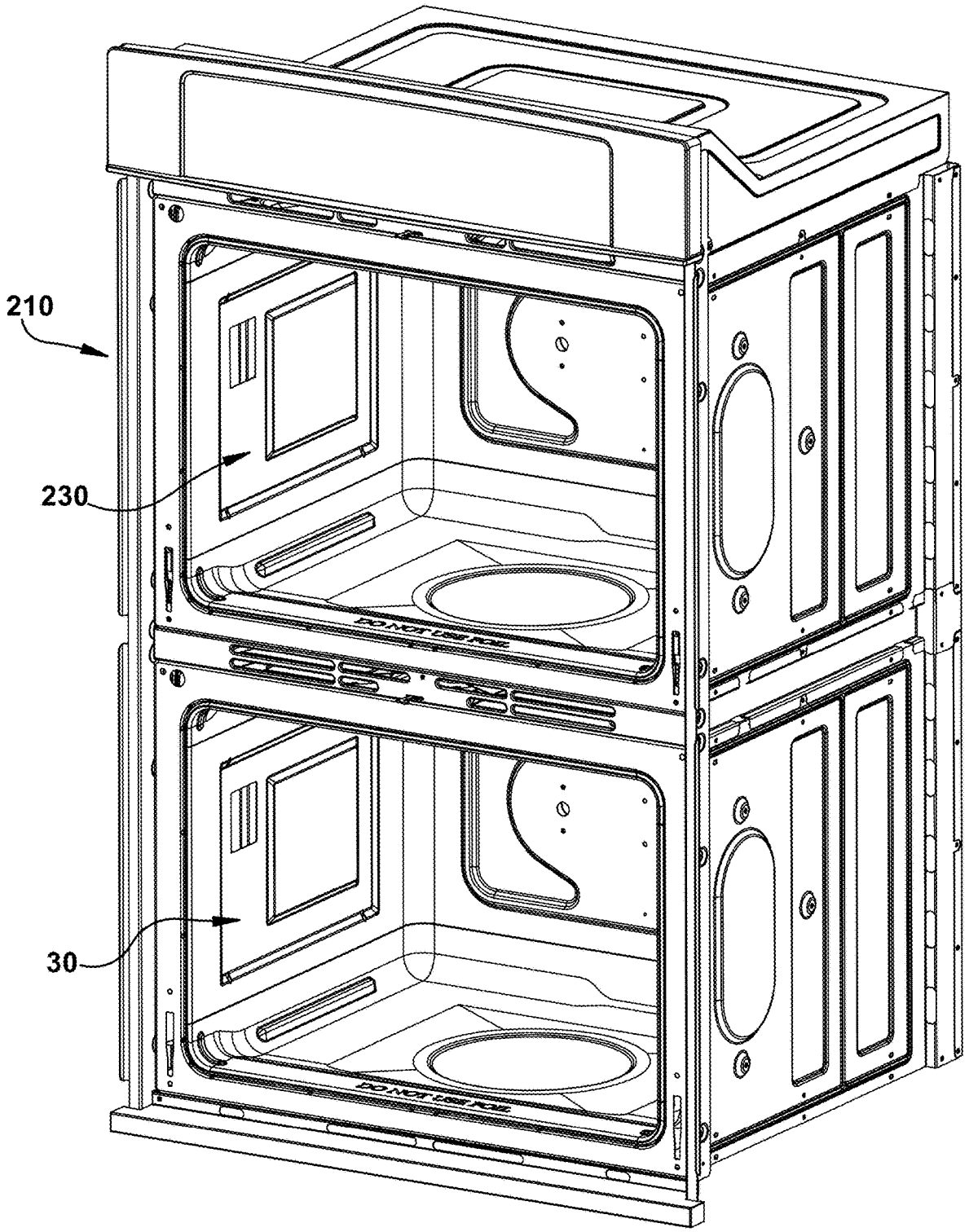
FIG. 2 is a front perspective view of a double oven having an upper oven-cavity wrapper and a lower oven-cavity wrapper with doors of each oven-cavity wrapper removed.

FIG. 1 illustrates a cooking appliance 10, such as a freestanding range as shown in the figure. Although in FIG. 1 the appliance 10 is illustrated as a freestanding range, it also could be a built-in, wall-oven (including a double wall oven) or slide-in appliance. Other configurations could also be used. The appliance 10 includes an outer housing 20 which can be formed of decorative outer panels, an oven-cavity or cooking cavity wrapper 30 defining an oven cavity with a front opening 32, a heating element 40 and a door 50 for closing the front opening 32 of the oven cavity. As shown in FIG. 1, the appliance can include both the oven (i.e. cooking cavity wrapper 30) a cooktop 60. However, alternate embodiments of the cooking appliance can include only the oven (cooking cavity wrapper 30) without the cooktop 60, and can be used in a variety of different configurations such as built-in gas ovens, etc. In addition, the appliance 10 may include more than one oven-cavity wrapper 30. For example, the appliance 10 may be a double oven 210 (FIG. 2) that includes two oven-cavity wrappers 30, 230 wherein an upper oven-cavity wrapper 230 is disposed vertically above a lower oven-cavity wrapper 30. A double-cavity configuration may be used in a built-in wall oven range, freestanding range, or other configurations. However, configurations are not limited thereto and more than two oven cavities may be included in other embodiments. In such embodiments, the upper (second) oven-cavity wrapper can be provided as part of a second oven module to be disposed above the first (lower) oven-cavity wrapper 30, as will be further described.

The oven door 50 is used to close the front opening 32 of the oven-cavity from an outside area external to the appliance 10. The oven door 50 is pivotally mounted to the appliance 10, e.g., to a lower frame. The door 50 can be pivoted around a horizontal pivot point (not shown on FIG. 1) between a horizontal position in which the front opening 32 is open for access by the user of the appliance, and a vertical position in which the front opening 32 is closed by the door 50. Alternatively, the door 50 may be mounted to a left side or a right side at the front frame of the appliance 10 to provide a side-swing door configuration. In this configuration, the door 50 can pivot around a vertical pivot point adjacent to a side end of the oven-cavity wrapper 30. The door 50 includes a transparent section, such as a glass window to allow a user the ability to see into the oven-cavity wrapper 30 during operation of the appliance 10 without opening the door 50.

Figure 3B:
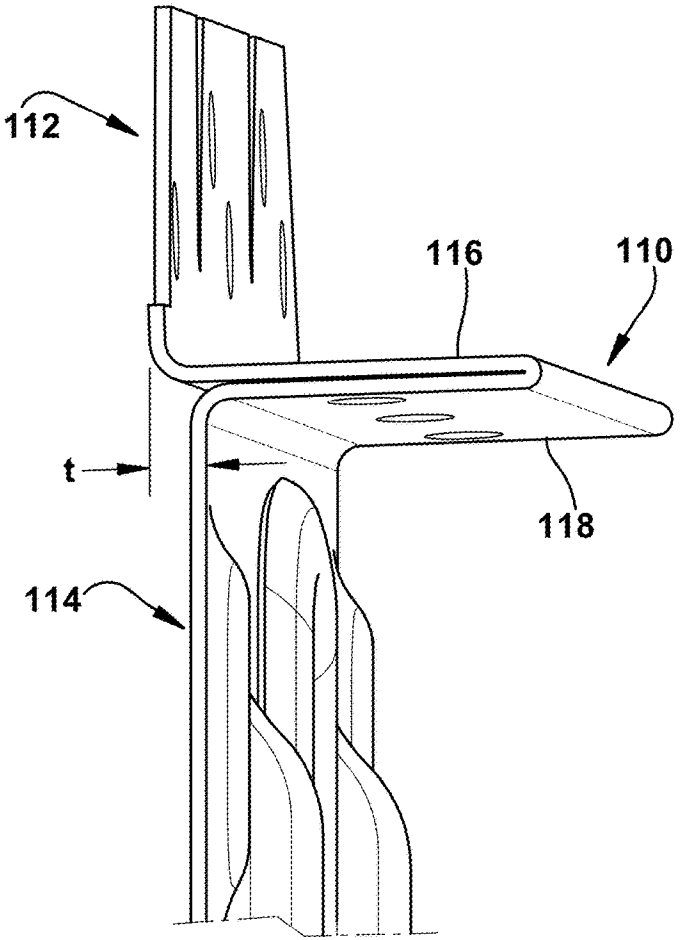
FIG. 3B is an enlarged section view of a hemmed shelf formed between an upper portion and a lower portion of the structural side wall of FIG. 3A.
Figure 3A:
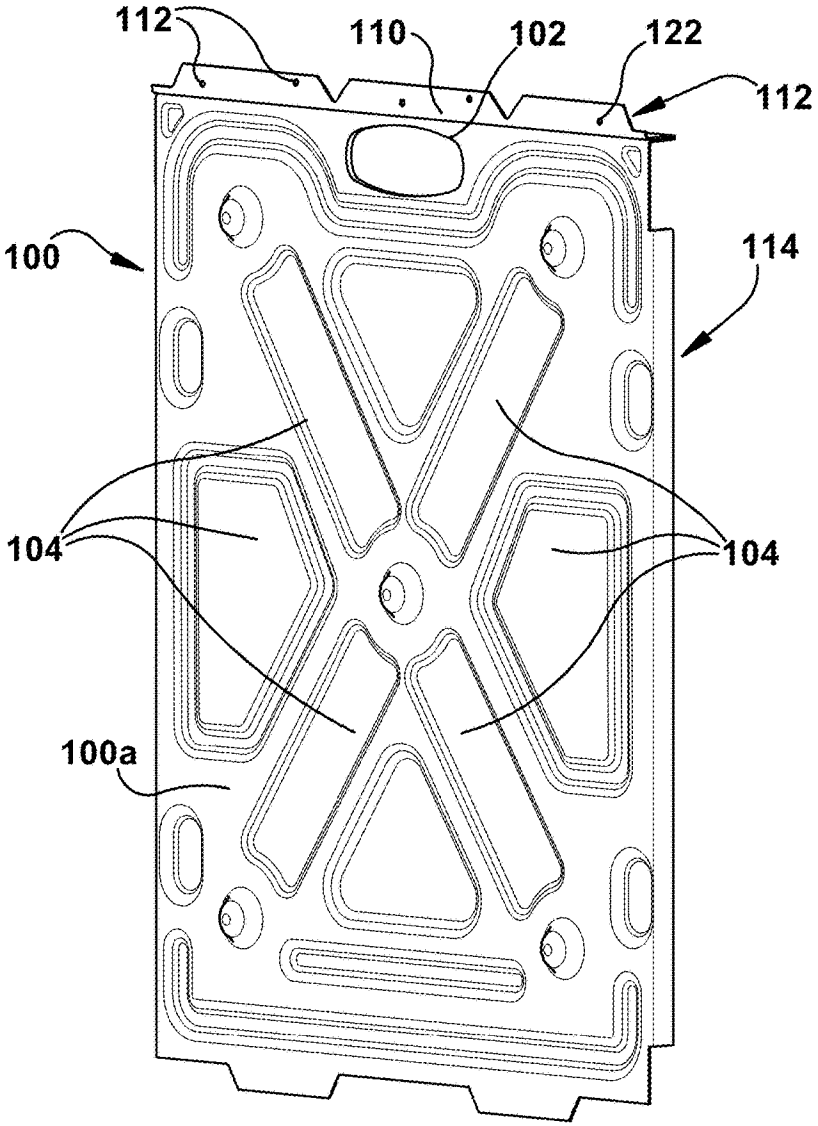
FIG. 3A is a side perspective view of a structural side wall of the oven of FIG. 1.

Turning now to FIGS. 3A and 3B, the appliance 10 (FIG. 1) includes a pair of structural side walls 100 (only one side wall 100 is illustrated in FIG. 3A) disposed at opposing lateral sides of the oven-cavity wrapper 30 (FIG. 1). For built-in appliances 10, such as a typical wall oven, the side walls 100 can also serve as the exterior housing elements of the appliance 10; i.e. the outermost panels defining the boundaries of the appliance 10 as shipped and installed. However, for freestanding appliances 10, the structural side walls 100 can be overlaid with decorative panels that present a more desirable aesthetic appearance to the appliance 10 from the outside. In this case, the decorative outer (side) panels can be affixed to the structural side walls 100 via conventional fasteners or adhesives.

The side walls 100 are disposed at the lateral sides of the appliance 10 and bound therebetween the various components of the appliance 10, forming the structural support therefor. For example, in addition to the oven-cavity wrapper 30 (FIGS. 1, 4 and 5), the side walls 100 may bound other components or modules of the appliance 10, e.g., a cooling module 120 (FIG. 4), cooktop 60 (FIG. 1) and/or microwave module 130 (FIG. 5). In conventional assemblies, components such as the cooktop 60, the cooling module 120 and the microwave module 130 are mounted to the structural side walls 100 via brackets and fasteners, which must be separately supplied and affixed during manufacturing, adding steps and cost, and often requiring manual interventions.

In the present embodiment each structural side wall 100 is made from a sheet metal and is formed to include various features, e.g., openings 102, recesses or channels 104, etc. in a planar surface 100*a* of the side wall 100. The foregoing features may be used for geo-locating mounting positions over the side wall 100 for the oven-cavity wrapper 30 or other parts or modules of the appliance 10, as well as to introduce structural bracing to the side walls 100 via appropriately positioned and configured bends. Openings 102 may provide clearance for ducts (not shown) and/or cables (not shown) that connect to or facilitate operation of the various modules and other elements of the appliance. The recess or channels 104 may dimensioned and positioned to form integrated ribs or similar features to add strength to the side wall 100 as noted above. In this respect, the side wall 100 may function as a structural member to allow other components to be mounted to the side wall 100. In this respect, structural rigidity may be added to the appliance 10 without requiring additional brackets and braces, which increase the overall weight and add cost manufacturing the appliance 10.

In the embodiment shown in FIG. 3A, the structural side wall 100 includes an elongated hemmed shelf 110 that extends a length of the side wall 100, i.e., from a first (front) end of the side wall 100 to a second (rear) end of the side wall opposite the first end. The hemmed shelf 110 is formed via bends in the sheet metal that forms the side wall 100. During fabrication the sheet metal is bent to form a U-shaped, inward-extending flange depending from an upper portion 112 and a lower portion 114 of the side wall 100. It is contemplated that the width of the upper portion 112 and the lower portion 114 may be the same as one another, according to the common uniform width of the sheet metal used to form the side wall 100 prior to introducing the U-shaped flange that defines the hemmed shelf 110. Alternatively, if desired (e.g. to provide varying degrees of structural robustness depending on the components to be emplaced at the respective portions of the side wall 100), the upper and lower portions 112 and 114 of the side wall can have different widths. These different widths can be introduced while manufacturing the sheet metal that will be bent to form the hemmed shelf 110 (i.e. at either side of the portion of the sheet metal that will be bent to form the shelf), such as by selective rolling or drawing the sheet metal. Alternatively, the different widths can be introduced after the hemmed shelf 110 is introduced, e.g. via localized rolling.

The distance that the hemmed shelf 110 projects inwardly from the side wall 10 (referred to as a "depth" of the hemmed shelf 110) may be selected to achieve a desired structural rigidity and robustness. For example, shallow-depth hemmed shelves 110 can provide more rigidity than deeper hemmed shelves 110. Further, a thickness of the hemmed shelf 110 may be selected to provide a desired rigidity and robustness. The overall size of the appliance 10 and the weight of the components supported by the side wall 100 may contribute to the selection of the depth and the thickness of the hemmed shelf 110. For example, for most conventional 24"-30" applications the opposing hemmed shelves 110 used to support typical appliance modules, e.g. a microwave or convection oven (discussed in detail below), can have a thickness in the range of 0.02 to 0.04; for example 0.023" to 0.039" when made from metal (e.g. steel), and a depth of 0.5" to 2" to provide the desired rigidity and robustness.

The U-shaped flange defining the hemmed shelf 110 includes a top leg 116 and a bottom leg 118 that preferably are disposed in face-to-face adjacency so as to define essentially a common flange whose strength is provided by both the top and bottom legs 116 and 118. In a preferred embodiment, the top leg 116 and the bottom leg 118 are in intimate face-to-face contact across substantially their entire adjacent surfaces. As will be appreciated and become clearer below, each of the opposing structural side walls 100 includes a respective hemmed shelf 110 at approximately the same height and opposing one another at either lateral side of the appliance 10. In this manner, the cooperating shelves 110 at the opposing side walls 100 provide supporting surfaces on which a module can be placed and supported above the subjacent oven-cavity wrapper 30, in order to secure that module to the appliance 10. Once the desired module has been placed and is supported by the opposing hemmed shelves 110, it is contemplated that a plurality of fasteners, e.g., screws, bolts or rivets (not shown) or holes (not shown) may be used to secure that module to the hemmed shelves 110 in order to affix it to the appliance 10. In this manner, although separate fasteners can be used to secure the module to the structural side walls 100, no separate structural support elements, such as brackets, will be necessary. In essence, the support bracketry is built into, and formed integrally with, the structural side walls 100 that already provide structural support to the appliance as a whole. As illustrated in FIG. 3A, a plurality of mounting holes 122 may extend laterally through the upper portion 112 of the side wall 100, above the hemmed shelf 110, if desired to provide additional securement/anchoring points for bolting an emplaced module to the side wall 100 once it has been positioned on the hemmed shelf 110 for support.

As illustrated in FIG. 3B, the upper portion 112 can be laterally, outwardly offset from the lower portion 114 a distance "t." It is contemplated that the offset "t" between the upper portion 112 and the lower portion 114 may be dimensioned to allow components or modules of widths larger or smaller than a width of the oven-cavity wrapper 30 or other subjacent component or module to be mounted thereabove and secured to the side walls 100 via the opposing hemmed shelves 110. It is contemplated that the offset "t" may be selected to provide a desired clearance to ease assembly. The number of components supported by the wall 10 may also influence the offset "t."

As illustrated in FIG. 3A, the hemmed shelf 110 is positioned at a location on the side wall 100 such that a height of the upper portion 112 can be appreciably less than a height of the lower portion 114. This may be the case, for example, when lower appliance element/module (e.g. an oven having oven-cavity wrapper 30) is manufactured as its own module, having the side walls 100 as its structural boundaries/supports. In this manner, those side walls 100 are provided in the first instance as side walls of that lower appliance/oven, and the hemmed shelves 110 are disposed at a height just above the operative components (e.g. oven-cavity wrapper 30) thereof, in order to supply a mounting location for fixing an upper module thereto. In such a case, the upper module (e.g. a microwave module) would have been separately manufactured and any structure necessary to ensure it is structurally robust for shipment and assembly will have already been incorporated with it. Accordingly, additional height of the side walls 100 to laterally bound the upper module would be unnecessary, such that only so much additional height of the side walls above the hemmed shelves 110 is supplied as appropriate to provide a robust mounting support for the upper module when attached.

Figure 3C:
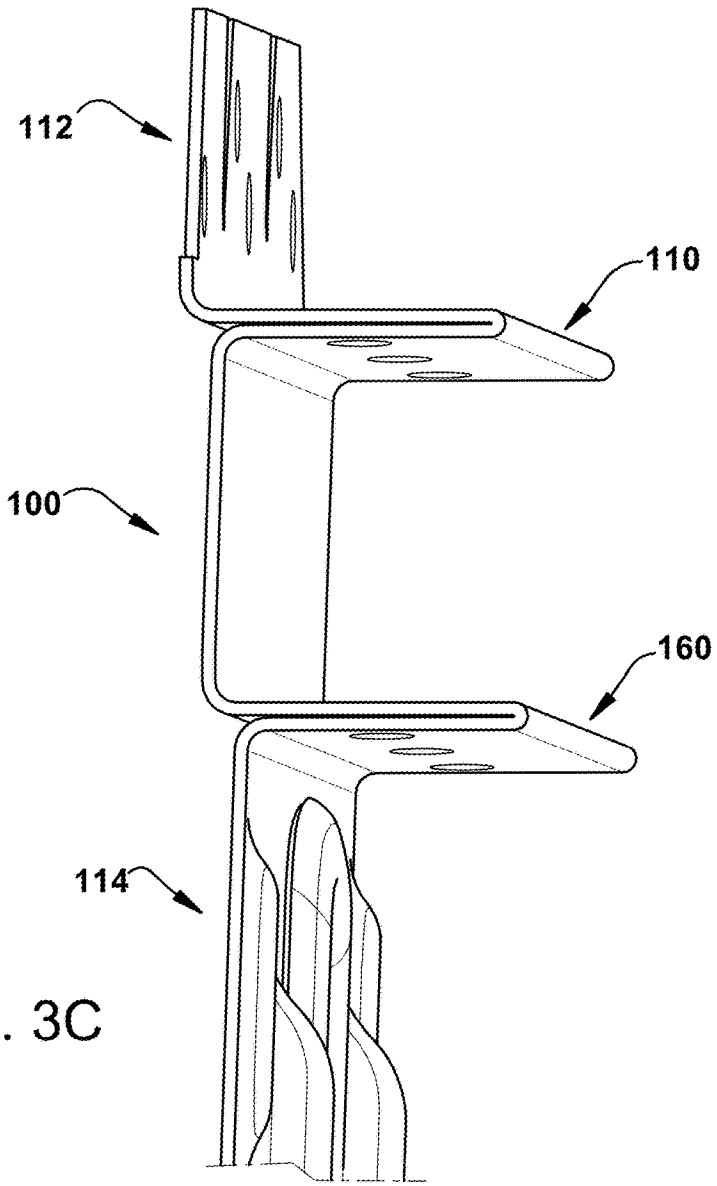
FIG. 3C is an enlarged section view of two spaced-apart hemmed shelves formed in the structural wall of FIG. 3A.

However, it is contemplated that the hemmed shelf 110 may be positioned at any other elevation along the side wall 100 so that the side wall 100 may be used with oven-cavity wrappers 30 of different heights, or to supply additional structural support to the overall appliance 10 once an upper module has been affixed. It is also contemplated that two or more vertically spaced-apart hemmed shelves 110, 160 (FIG. 3C) may be disposed at various heights along the side wall 100 so the side wall 100 may support a series of stacked modules. The two or more vertically spaced-apart hemmed shelves 110, 160 may also allow a single side wall 100 to be used with multiple appliances 10 wherein one hemmed shelf 110 is used with one oven and another hemmed shelf 160 is used with a different oven—e.g. in a double wall oven where each oven is supplied as a separate module. Using one side wall 100 for multiple ovens may reduce inventory cost and make manufacturing of multiple ovens simpler.

Figure 4:
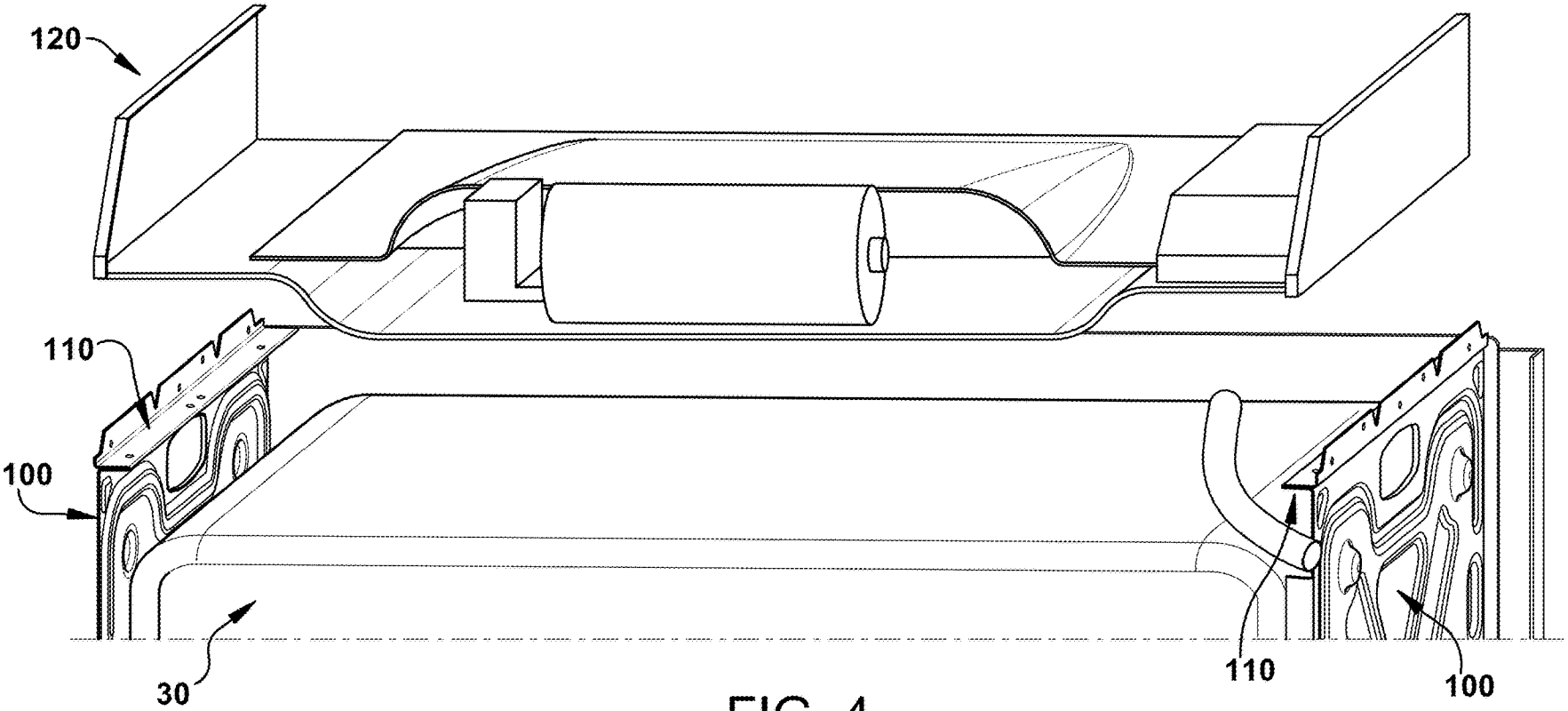
FIG. 4 is an exploded front view, with external parts removed, illustrating a cooling module disposed above an oven-cavity wrapper of an oven, according to an embodiment.
Figure 5:
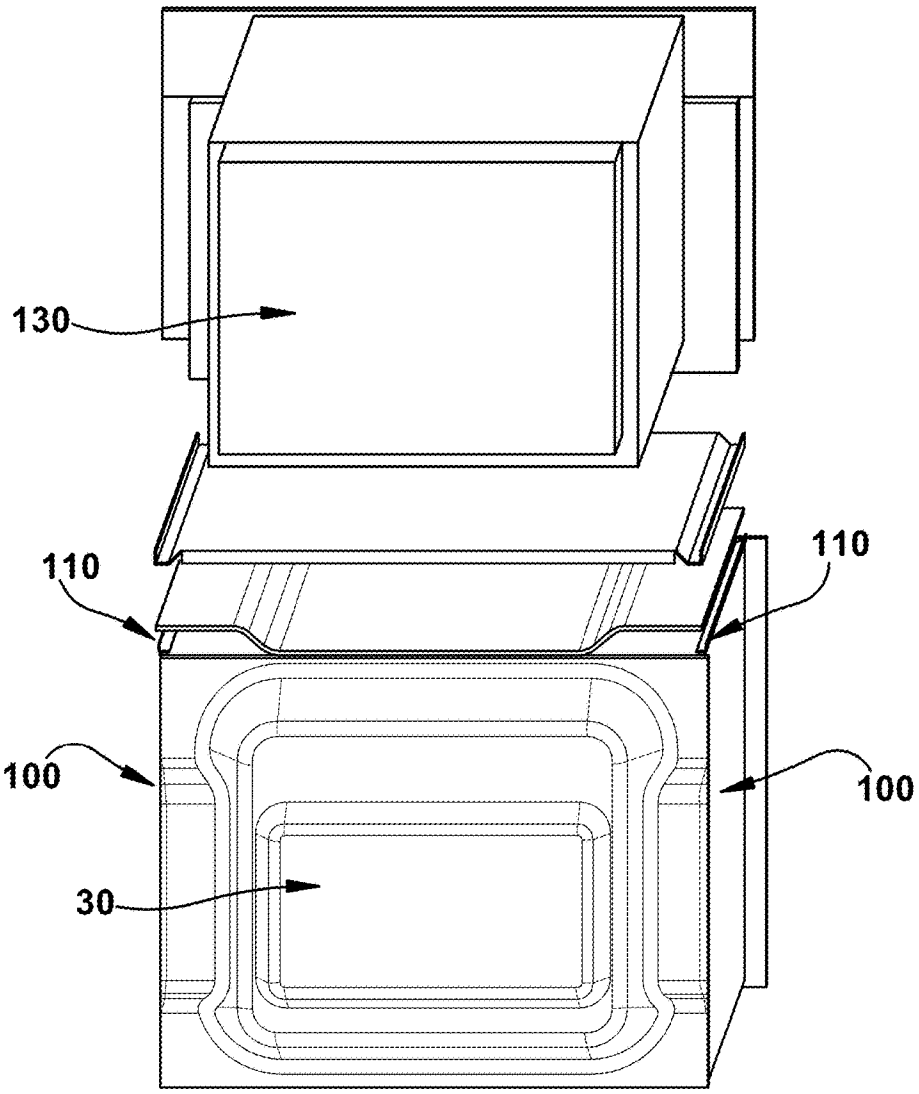
FIG. 5 is an exploded rear view, with external parts removed, illustrating a microwave module disposed above an oven-cavity wrapper of an oven, according to another embodiment.

Referring now to FIG. 4, an embodiment is illustrated wherein a cooling system is supplied as a separate cooling module 120, to be installed above a lower oven. In this embodiment, the cooling module 120 is lowered until it rests on hemmed shelves 110 that extend from opposing side walls 100. Once so emplaced, conventional fastener such as screws and rivets can be used to affix the cooling module 120 in place. Importantly, however, those fasteners are not used to structural support the cooling module 120, because all structural support is supplied by the hemmed shelves 110 as well as the respective upper portions 112 of the side walls 100 that bound the cooling module 120 once seated. Thus, the fasteners need not have particularly high sheer strength to resist displacement of the cooling module 120 once seated. The aforementioned features of the side walls 100 will carry substantially all such loads. Rather, the fasteners can be simple, inexpensive fasteners that need be strong enough only to fix the cooling module 120 in place; but not to resist significant sheer upon displacement thereof.

In another embodiment shown in FIG. 5, the separate module disposed above a lower oven is a microwave module 130, which is seated on and supported by the hemmed shelves 110 similarly as described above. Also similarly, again conventional fasteners can be used to fix it in place once seated. But those fasteners need not be strong against sheer to prevent displacement of the microwave module 130. Rather, again those loads will be carried primarily by the features of the structural side walls 100. The same is true for other modules as may be seated on and secured to the hemmed shelves 110 as disclosed herein.

It is contemplated that various other modules may be mounted to the hemmed shelves 110. The hemmed shelves 110 may be used to aid in quick and efficient placement of the desired module on the hemmed shelves 110 during manufacturing of the appliance 10. For example, the hemmed shelves 110 may allow an automated system that utilizes robots to quickly and accurately locate the hemmed shelves 110 and then place the desired module on the hemmed shelves 110. Even where deemed unnecessary for structural support, the upper portions 112 of the side walls 100 above the hemmed shelves 110 may be utilized to assist automated positioning and assembly of such modules, to assure proper alignment thereof on the shelves 110. The automated system may use the various features of the hemmed shelves 110, e.g., the mounting holes 122 to aid in the accurate placement of the desired module on the hemmed shelves 110.

Although embodiments described herein are made with reference to example embodiments, it should be appreciated by those skilled in the art that various modifications are well within the scope and spirit of this disclosure. Therefore, the scope of the example embodiments is not limited herein. The disclosure is intended to include all such modifications and alterations disclosed herein or ascertainable herefrom by persons of ordinary skill in the art without undue experimentation. It will be appreciated that the burner described herein can be used in convection ranges or ovens for residential and restaurant or other commercial or industrial applications.

What is claimed is:

1. An appliance comprising:

a cooking cavity wrapper; and a first side wall disposed laterally adjacent a first side of the cooking cavity wrapper and including a first hemmed shelf formed as a U-shaped bend therein, the U-shaped bend defining an inward-extending flange comprising a top leg and a bottom leg having respective and opposing first and second surfaces extending substantially parallel and adjacent to one another across substantially the entire first surface wherein said top leg and said bottom leg of said first hemmed shelf are in intimate face-to-face contact, said first hemmed shelf adapted to support a module of said appliance above said cooking cavity wrapper.

2. The appliance of claim 1, further comprising a second side wall disposed laterally adjacent a second side of the cooking cavity wrapper and including a second hemmed shelf formed as a U-shaped bend therein, said second hemmed shelf opposing said first hemmed shelf and adapted to cooperate therewith to support the module of said appliance above said cooking cavity wrapper.

3. The appliance of claim 1, said first side wall being made of sheet metal.

4. The appliance of claim 1, further comprising the module supported on said first hemmed shelf above said cooking cavity wrapper.

5. The appliance of claim 4, wherein the module is one of a cooling module, a microwave oven or an upper oven-cavity wrapper.

6. The appliance of claim 1, excluding additional brackets for providing structural support to said module in said appliance.

7. The appliance of claim 1, wherein said top leg and said bottom leg of said first hemmed shelf are in intimate face-to-face contact across substantially their entire adjacent surfaces.

8. The appliance of claim 1, wherein the first side wall includes a further hemmed shelf vertically spaced apart from said first hemmed shelf and adapted to support a second module.

9. The appliance of claim 1, the first side wall including a plurality of recesses forming integrated ribs for increasing a rigidity of the first side wall.

10. The appliance of claim 1, wherein the first side wall is secured to the cooking cavity wrapper.

11. The appliance of claim 1, wherein the first hemmed shelf extends a full length of the first side wall from a first end to a second end thereof.

12. An appliance comprising:

a cooking cavity wrapper; and a first side wall disposed laterally adjacent a first side of the cooking cavity wrapper and including a first hemmed shelf formed as a U-shaped bend therein, the U-shaped bend defining an inward-extending flange comprising a top leg and a bottom leg disposed in face-to-face adjacency with one another, wherein a width of the top leg is different than a width of the bottom leg such that an upper portion of the first side wall above the first hemmed shelf is offset relative to a lower portion of the side wall below the first hemmed shelf, said first hemmed shelf adapted to support a module of said appliance above said cooking cavity wrapper.

13. An appliance comprising:

a cooking cavity wrapper;

a first side wall disposed laterally adjacent a first side of the cooking cavity wrapper and including a first hemmed shelf extending inward therefrom, the first hemmed shelf formed as a U-shaped bend in the first side wall, the U-shaped bend defining an inward-extending first flange comprising a top leg and a bottom leg disposed in face-to-face adjacency with one another;

a second side wall disposed laterally adjacent a second side of the cooking cavity wrapper and including a second hemmed shelf extending inward therefrom, the second hemmed shelf formed as a U-shaped bend in the second side wall, the U-shaped bend defining an inward-extending second flange comprising a top leg and a bottom leg having respective and opposing first and second surfaces extending substantially parallel and adjacent to one another across substantially the entire first surface wherein said top leg and said bottom leg of said first hemmed shelf are in intimate face-to-face contact, said second hemmed shelf opposing said first hemmed shelf; and a module disposed above the cooking cavity wrapper and resting on the first hemmed shelf and the second hemmed shelf without additional brackets to provide structural support to the module resting on the first and second hemmed shelves.

14. The appliance of claim 13, wherein the first hemmed shelf extends a full length of the first side wall from a first end to a second end thereof.

15. The appliance of claim 13, wherein the first hemmed shelf extends in a direction normal to a surface of the first side wall.

* * * * *